US005750215A

United States Patent [19]

Jaegge et al.

[11] Patent Number: 5,750,215

[45] Date of Patent: May 12, 1998

[54] HIGH SPEED PROCESS FOR MAKING FULLY-ORIENTED NYLON YARNS AND YARNS MADE THEREBY

[75] Inventors: Walter John Jaegge, Ponca City, Okla.; Francis Joseph Malone, Jr., Hixson, Tenn.; Frank Hudson Overton, Signal Mountain, Tenn.; Roger Allen Ross, Chattanooga, Tenn.; Ronald Edward Steele, Hixson, Tenn.

[73] Assignee: E. I. du Pont de Nemours and Company, Wilmington, Del.

[21] Appl. No.: 814,851

[22] Filed: Mar. 11, 1997

Related U.S. Application Data

[62] Division of Ser. No. 642,298, May 3, 1996, abandoned, which is a continuation of Ser. No. 380,911, Feb. 7, 1995, Pat. No. 5,558,826.

[51] Int. Cl.[6] ..... B27N 0/00; D02G 3/00; B65D 85/66; B65H 18/28

[52] U.S. Cl. ..... 428/34.2; 428/395; 206/392; 242/159; 242/128

[58] Field of Search ..... 428/364, 395, 428/34.2; 206/392; 242/159, 178

[56] References Cited

U.S. PATENT DOCUMENTS

| | | | |
|---|---|---|---|
| 1,996,791 | 4/1935 | Blake | 206/392 |
| 2,706,593 | 4/1955 | Caraher | 206/392 |
| 4,123,492 | 10/1978 | McNamara et al. | 264/210 F |
| 4,228,120 | 10/1980 | Bromley et al. | 264/176 F |
| 4,229,500 | 10/1980 | Adachi et al. | 428/373 |
| 4,983,448 | 1/1991 | Karageorgiou | 428/224 |
| 5,219,503 | 6/1993 | Boles, Jr. et al. | 264/103 |
| 5,360,667 | 11/1994 | Boyles, Jr. et al. | 428/364 |
| 5,419,964 | 5/1995 | Boyles, Jr. et al. | 428/364 |

FOREIGN PATENT DOCUMENTS

| | | | |
|---|---|---|---|
| 2 343 831 | 11/1977 | France . | |
| 31 46 054 A1 | 11/1981 | Germany | D01D 5/16 |
| 3146054 A1 | 11/1981 | Germany . | |
| 3508955 C2 | 5/1987 | Germany | D01D 5/16 |
| 61-132615 | 6/1986 | Japan | D01F 6/60 |
| 623 611 | 7/1979 | Switzerland | D01D 5/16 |
| 623511 | 7/1979 | Switzerland | D01D 5/16 |

*Primary Examiner*—Newton Edwards

[57] ABSTRACT

A coupled spin-draw process for making a fully-oriented nylon yarn including extruding molten nylon polymer with a selected RV through a spinneret and cooling to produce a yarn. The yarn is withdrawn from the quench zone with a feed roll rotating at a speed of at least 4500 mpm. The process further includes cold drawing followed by relaxing the yarn using a steam intermingling jet and then winding up.

3 Claims, 7 Drawing Sheets

HIGH SPEED PROCESS FOR MAKING FULLY-ORIENTED NYLON YARNS AND YARNS MADE THEREBY

This is a division of U.S. patent application Ser. No. 08/642,298, filed May 3, 1996, now abandoned, which is a continuation of U.S. patent application Ser. No. 08/380,911, filed on Feb. 7, 1995, which issued into U.S. Pat. No. 5,558,826 on Sep. 24, 1996.

BACKGROUND OF THE INVENTION

The present invention relates to the manufacture of continuous multifilament nylon yarns and more particularly relates to a high speed process for making fully-oriented nylon yarns and the resulting yarn products.

Continuous multifilament nylon textile yarns such as those of nylon 6,6 and nylon 6 are generally considered to be fully-oriented if they have elongations less than about 60%. While such yarns are used commercially for a variety of purposes, they are often used without texturing or bulking and thus are referred to as "flat yarns". Many are used in woven fabrics such as fabric for outerwear and also in warp knit fabrics such as fabrics for swimwear and auto upholstery. Dye uniformity in such fabrics is often critical to their value in use and it is generally desirable for fully-oriented yarns to be highly uniform to impart high dye uniformity to the fabric.

Known processes for making fully-drawn nylon yarns include the steps of extruding molten polymer, quenching the molten polymer to form filaments, coalescing the filaments to make a yarn and then drawing the yarn which reduces the elongation to the desired level. While the drawing can be done in a separate process, in most commercial processes used today the drawing step is integrated with the spinning step and such processes are called coupled "spin-draw" processes. Most conventional processes also include a relaxation step following drawing in which the tension on the yarn is reduced before winding-up, usually while heating the yarn.

One such known process for making fully-drawn yarn described in Swiss Patent No. 623 611. Swiss Patent No. 623 611 discloses the manufacture of nylon 6 yarns using a process in which the yarn is spun at 4000 meters per minute (mpm) (feed roll speed) and drawn in a draw step in which the unheated draw roll rotates at 5520 mpm. The yarn then undergoes a relaxation/entanglement step using a steam jet and wound is up at 4890 mpm.

If it is attempted to increase the speed of the process disclosed in Swiss Patent No. 623 611, the process has been found to be unsuitable for commercial use when the spinning speed (feed roll speed) substantially exceeds 4000 mpm. One problem which results at these speeds is a high number of broken filaments in the yarn. A second problem is yarn retraction on the package, i.e., the yarn retracts after winding with sufficiently strong forces to cause tube compression of, i.e., reduce the diameter or even crush an otherwise suitable tube core of cardboard construction. If the effect is severe enough, the resulting deformed yarn package with crushed tube core cannot be removed from the chuck on the wind-up without destroying the yarn.

One other problem with processes using unheated draw rolls as in Swiss Patent No. 623 611 is that the break elongation of the yarn generally cannot be reduced to less than about 50% without the number of filament breaks becoming unacceptable. Consequently, most yarn produced commercially using such processes has a break elongation of greater than about 50%.

SUMMARY OF THE INVENTION

In accordance with one form of the invention, a coupled spin-draw process is provided for making a fully-oriented nylon yarn. The process includes extruding molten nylon polymer having a formic acid relative viscosity of about 35 to about 70 through a spinneret into multiple molten polymer streams. The molten polymer streams are cooled in a quench zone to form filaments and the filaments are coalesced into a yarn. The yarn is withdrawn from the quench zone with a feed roll rotating at a peripheral speed of at least 4500 mpm. The process further includes drawing the yarn by advancing it to a draw roll rotating at a peripheral speed at least about 1.1 times the speed of the feed roll. The yarn is relaxed by passing the yarn after drawing through a chamber containing a steam atmosphere where the yarn is exposed to the steam atmosphere for a period of at least about 1 millisecond. The yarn is then wound up.

In accordance with a preferred form of the invention, the yarn is exposed to the steam atmosphere during the relaxing for a period of at least about 2 milliseconds, most preferably at least about 2.4 milliseconds.

In accordance with a another form of the invention, the coupled spin-draw process for making a fully-oriented nylon yarn includes extruding molten nylon polymer having a formic acid relative viscosity of about 35 to about 70 through a spinneret into multiple molten polymer streams. The molten polymer streams are cooled in a quench zone to form filaments and the filaments are coalesced into a yarn. The yarn is withdrawn from the quench zone with a feed roll rotating at a peripheral speed of at least 4500 mpm. The process further includes drawing the yarn by advancing it to a draw roll rotating at a peripheral speed at least about 1.1 times the speed of the feed roll. The yarn is relaxed by passing the yarn after drawing through a chamber containing a steam atmosphere. After the yarn exits the steam chamber, the yarn is contacted with a roll to control the tension of the yarn in the steam chamber. In addition, the yarn is lagged for a distance of at least about 2 meters, preferably at least about 3 meters, after leaving the steam atmosphere and before winding up.

In preferred processes in accordance with the invention, formic acid relative viscosity of the nylon polymer is about 40 to about 60. When the nylon polymer is homopolymer nylon 66, it is preferred for the formic acid relative viscosity to be about 45 to about 55, most preferably about 48 to about 53. When the nylon polymer is homopolymer nylon 6, it is preferred for the formic acid relative viscosity to be about 50 to about 60, most preferably about 53 to about 58.

In other preferred processes in accordance with the invention, the yarn is heated between the feed roll and draw roll to cause neck-drawing of the yarn to occur between the feed roll and the draw roll. Preferably, the feed roll and the draw roll are unheated.

The process of the invention enables the production of fully-oriented nylon yarn at higher feed roll speeds, higher wind-up speeds, and thus greater productivity than previously possible in the commercial operation of prior art processes. Further advantages are obtained when the feed roll withdrawing the yarn from the quench zone is rotating at a preferred peripheral speed of at least 5300 mpm. Preferably, the wind-up speed is at least about 5500 mpm, more preferably at least about 6000 mpm, and most preferably at least about 6500 mpm. Known processes have not capable of providing wind-up speeds substantially in excess of about 6000 mpm in commercial operations.

At these high speeds, the process produces high quality fully-oriented nylon yarns which have excellent dye uniformity and are suitable for critical dye applications. The yarns produced have both low broken filament levels and decreased yarn retraction so that tube compression is controlled to levels acceptable for commercial processes. Moreover, the break elongation of the yarn can be less than 50% while still maintaining acceptable break levels.

In accordance with another aspect of the invention, a fully-oriented yarn is provided which comprises nylon 66 polymer having a formic acid relative viscosity (RV) of about 40 to about 60 and having an elongation at break of about 22% to about 60%, a boil-off shrinkage between about 3% and about 10%, a tenacity of about 3 to about 7 grams per denier (gpd), a crystalline perfection index of about 61 to about 85, an orientation angle of about 12 to about 19, a long period spacing of about 79Å to about 103Å and a long period intensity of about 165 to about 2240.

In accordance with the invention, a fully-oriented yarn is provided which comprises nylon 6 polymer having a formic acid relative viscosity (RV) of about 40 to about 60 and having an elongation at break of about 22% to about 60%, a boil-off shrinkage between about 7% and about 15%, a tenacity of about 3 to about 7 gpd, an orientation angle of about 9 to about 16, a long period spacing of about 65Å to about 85Å and a long period intensity of about 100 to about 820. Preferably, the boil-off shrinkage of the nylon 6 fully-oriented yarn is about 7% to about 10%.

DETAILED DESCRIPTION

The process in accordance with the invention is useful for making yarns of a variety of melt-spinnable nylon polymers and copolymers. Preferably, the nylon polymer comprises at least about 85% poly(hexamethylene adipamide) (nylon 6,6) units or at least about 85% poly(ε-caproamide) (nylon 6) units. Most preferably, the nylon is either homopolymer nylon 6,6 or homopolymer nylon 6.

Figure 1:
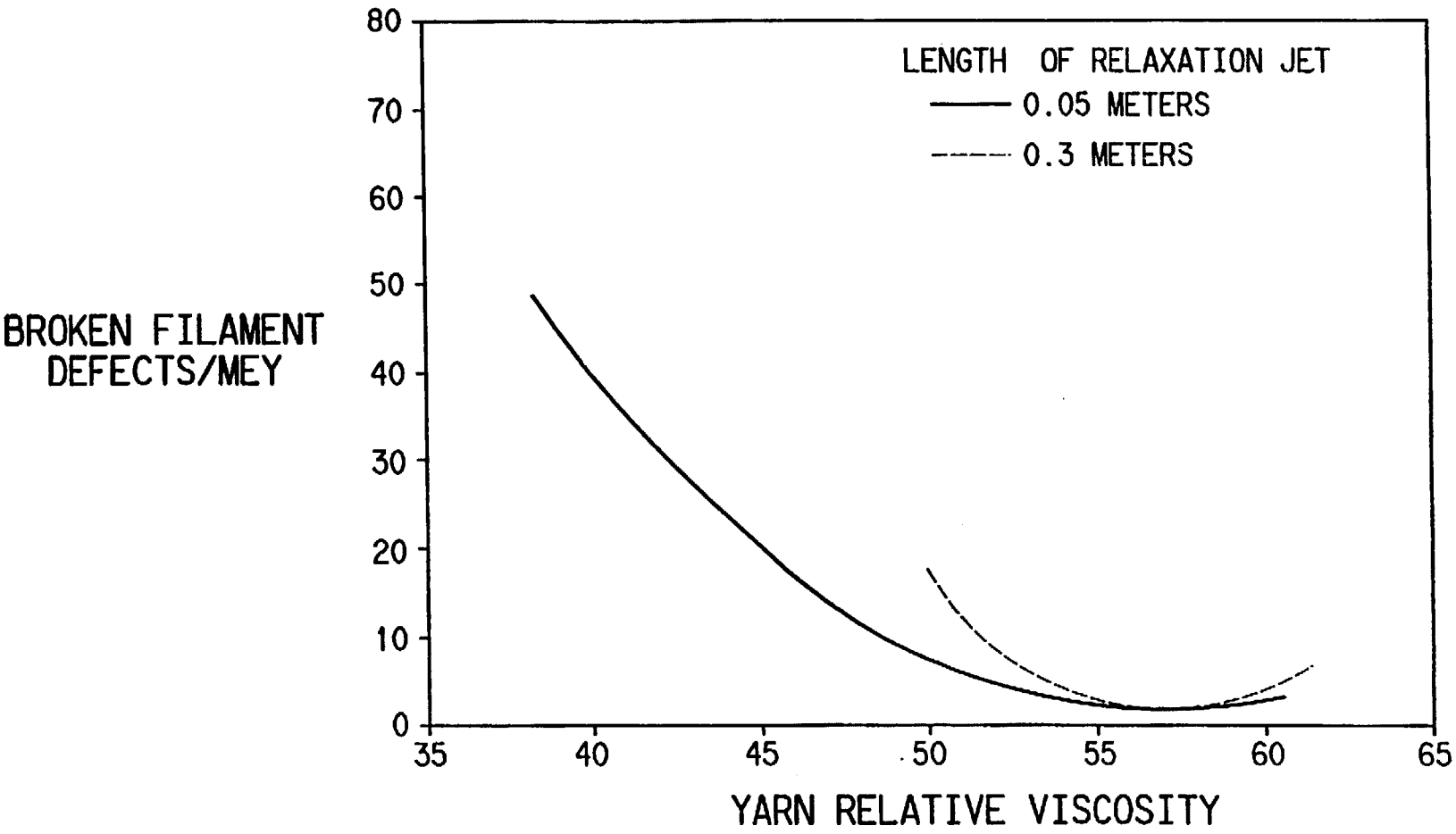
FIG. 1 is a graphical representation of broken filament defects per million ends of yarn (MEY) versus the yarn relative viscosity for preferred nylon 6,6 processes in accordance with the present invention using steam relaxation jets having two different chamber lengths.
Figure 3:
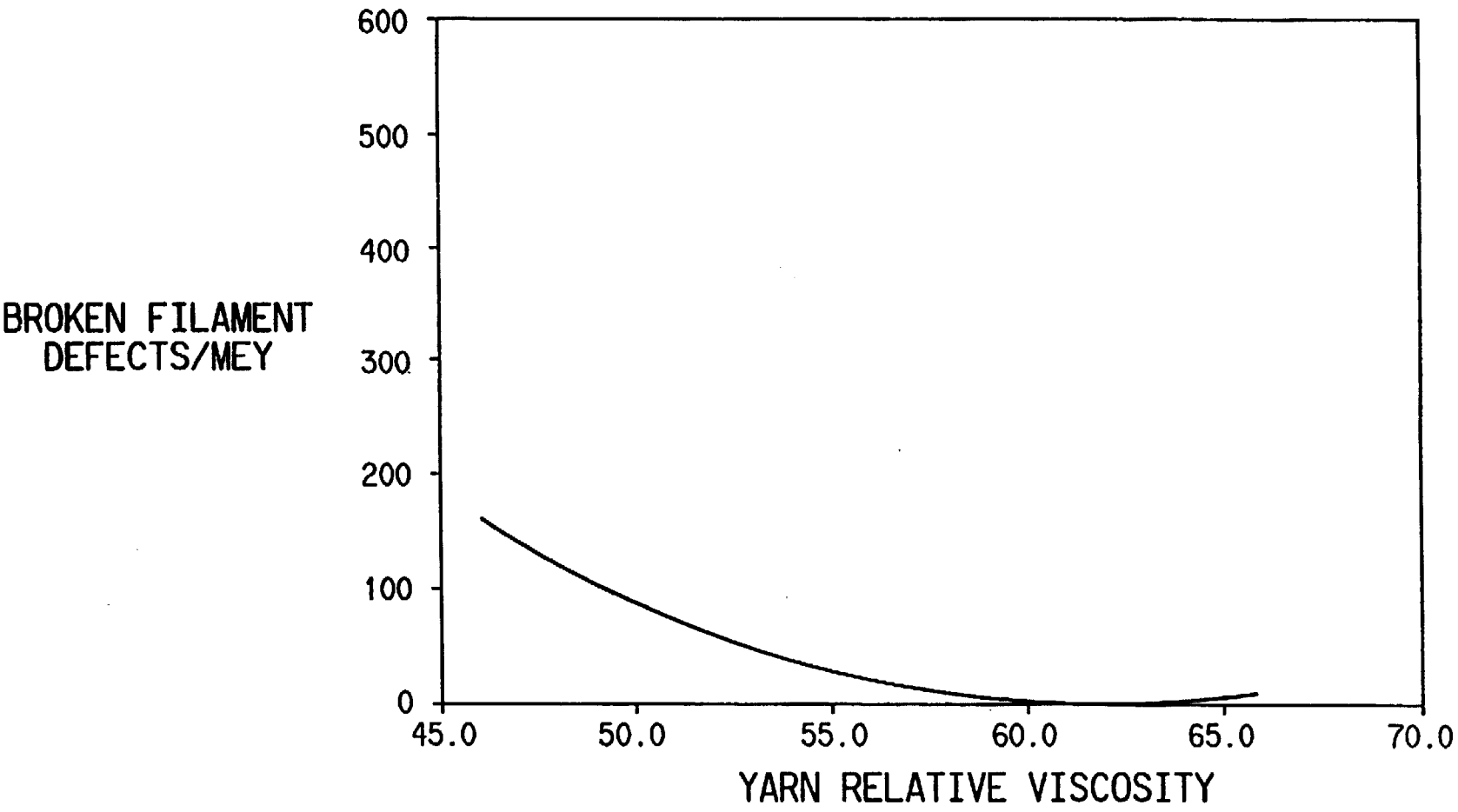
FIG. 3 is a graphical representation of broken filament defects per million ends of yarn (MEY) versus the yarn relative viscosity for a preferred nylon 6 process in accordance with the present invention.

It has been discovered that the formic acid relative viscosity (RV) of the nylon polymer is very important to the process. At the high feed roll speeds employed in the practice of the present invention, there is a propensity for broken filament defects to occur and it has further been observed that the number of broken filament defects increases with decreasing RV. When the RV is too low in a process in accordance with the invention, the number of broken filament defects can become too great for acceptable processing into fabrics. As illustrated in FIG. 1 for a process in accordance with the invention at feed roll speeds of approximately 4500–6000 mpm, increasing the RV of the nylon 66 polymer in a process in accordance with the invention decreases the number of broken filament defects per million end yards. Similarly, as illustrated in FIG. 3, the same effect is observed for homopolymer nylon 6 in the process.

Figure 2:
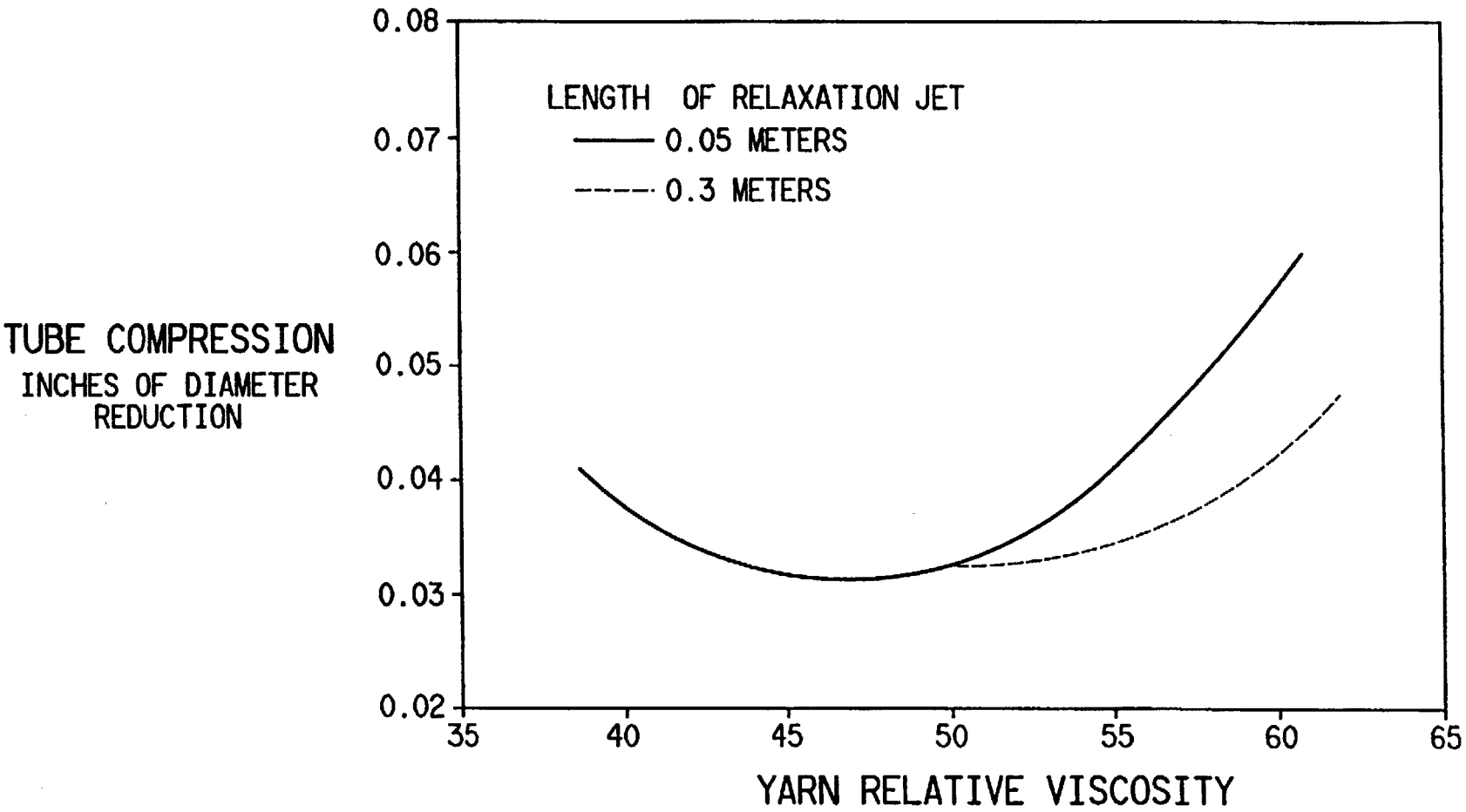
FIG. 2 is a graphical representation of yarn tube compression, i.e., tube diameter reduction, versus the yarn relative viscosity for preferred nylon 6,6 processes in accordance with the present invention using steam relaxation jets having two different chamber lengths.
Figure 4:
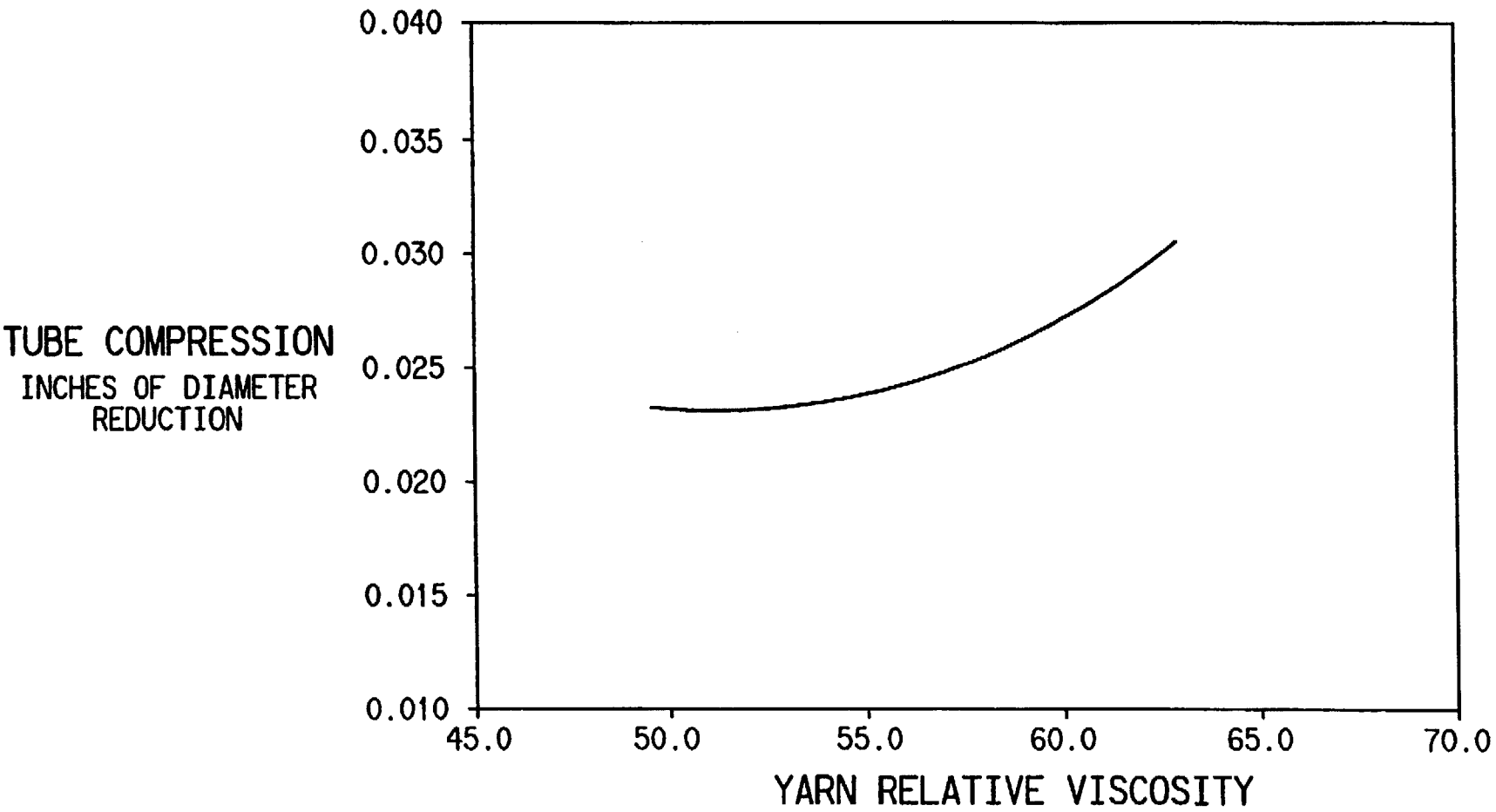
FIG. 4 is a graphical representation of yarn tube compression versus the yarn relative viscosity for a preferred nylon 6 process in accordance with the present invention.

While an increase in polymer. RV is desirable to reduce broken filament defects, it has also been discovered that as the RV of the polymer increases, the tendency of the yarn to retract on the yarn packages after wind-up also increases and that the effect is greater with increasing speeds. If the polymer RV is too high, the yarn retraction forces can be sufficiently great that tube compression, i.e., a decrease in inside diameter of a yarn tube, causes problems. With tubes of the cardboard type, the retractive forces can crush the tubes so that the finished yarn package cannot be removed from the wind-up chuck without damage. Even if steel or other non-deformable tubes are employed, the retraction of the yarn can deform the arrangement of the yarn on the package, i.e., cause "package bulge", making unwinding for use difficult. For a process in accordance with the invention at feed roll speeds of approximately 4500–6000 mpm in which the yarn is drawn sufficiently to reduce the elongation to less than about 60%, FIG. 2 shows the relationship of tube compression versus RV measured on a cardboard tube 24 hours after wind-up. FIG. 4 is a similar plot for nylon-6.

In a process in accordance with the invention, the nylon polymer has a formic acid relative viscosity (RV) within the range of about 35 to about 70 so that an acceptable balance of broken filament defects and tube compression can be provided. In accordance with preferred form of the invention, the RV is about 40 to about 60. When the nylon polymer is homopolymer nylon 66, it is preferred for the formic acid relative viscosity to be about 45 to about 55, most preferably about 48 to about 53. When the nylon polymer is homopolymer nylon 6, it is preferred for the formic acid relative viscosity to be about 50 to about 60, most preferably about 53 to about 58.

The RV of the nylon polymer can be adjusted to the appropriate level by any of a variety of known techniques. When the nylon polymer is supplied in "flake" or pellet form, it has been found to be particularly suitable to use solid phase polymerization and/or flake conditioning to provide nylon flake which will provide the desired RV when melted. Screw extruders have been found to be suitable for melting the solid phase polymerized/conditioned polymer flake.

Figure 6:
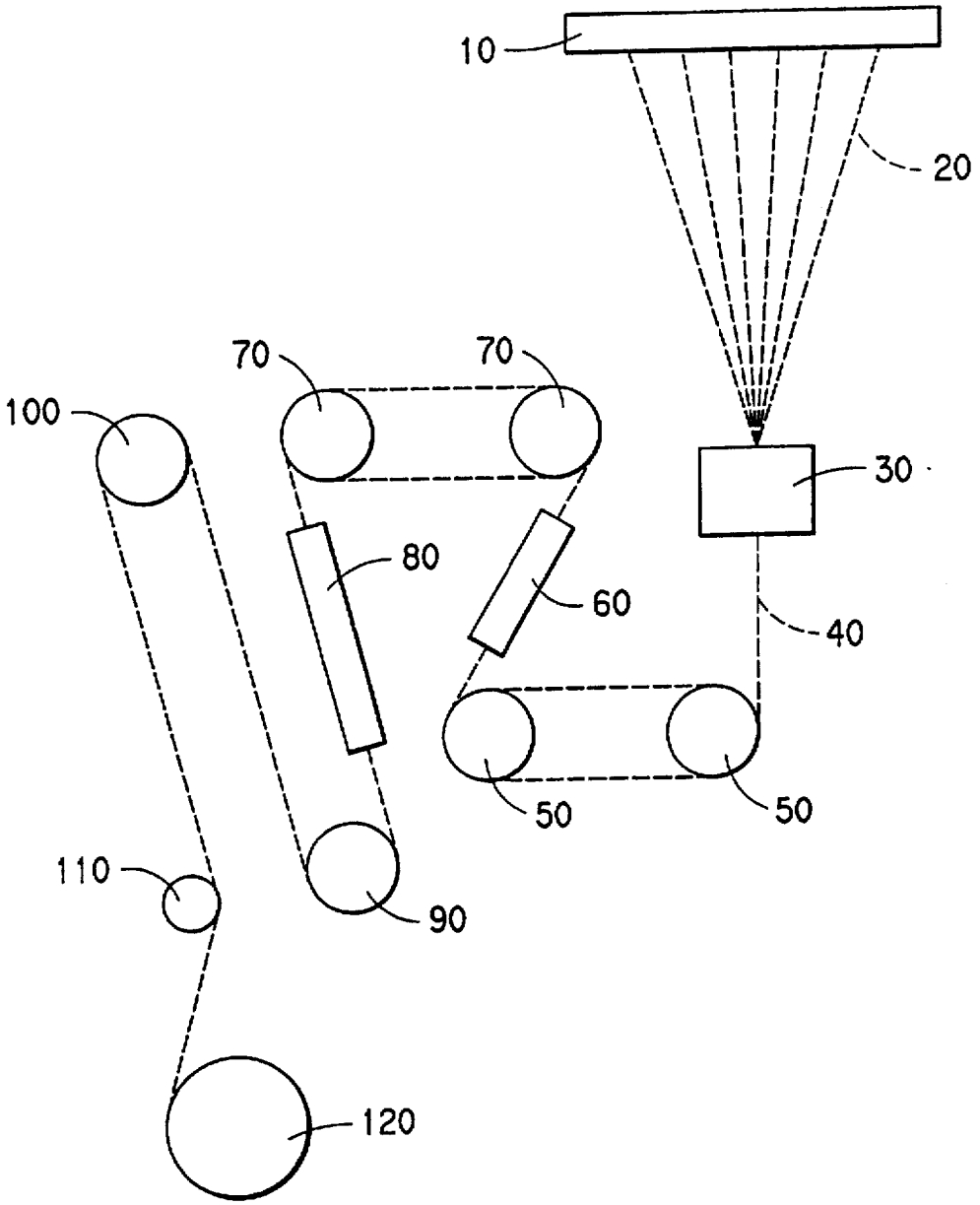
FIG. 6 is a diagrammatical view of a preferred spinning machine for the practice of a preferred process in accordance with the present invention.

With reference the FIG. 6 which illustrates a preferred spinning machine for carrying out a process in accordance with the invention, the molten nylon polymer having the desired RV is supplied using a conventional extruder (not shown) to a spin pack 10 with multi-capillary spinneret plate. The molten nylon polymer is extruded through the spinneret into multiple melt streams that are cooled in a quench zone 20 to form filaments which are coalesced at a finish applicator 30 into a yarn 40. The yarn 40 is withdrawn from the quench zone by a pair of unheated feed godet rolls 50 which rotate at a peripheral speed of at least about 4500 meters per minute (mpm). Preferably, the peripheral speed of these rolls is at least about 5300 mpm.

The yarn 40 is then drawn by advancing to a pair of draw godet rolls 70 rotating at a peripheral speed of at least about 1.1 times the speed of the feed rolls. The draw godet rolls 70 preferably are unheated.

Figure 5:
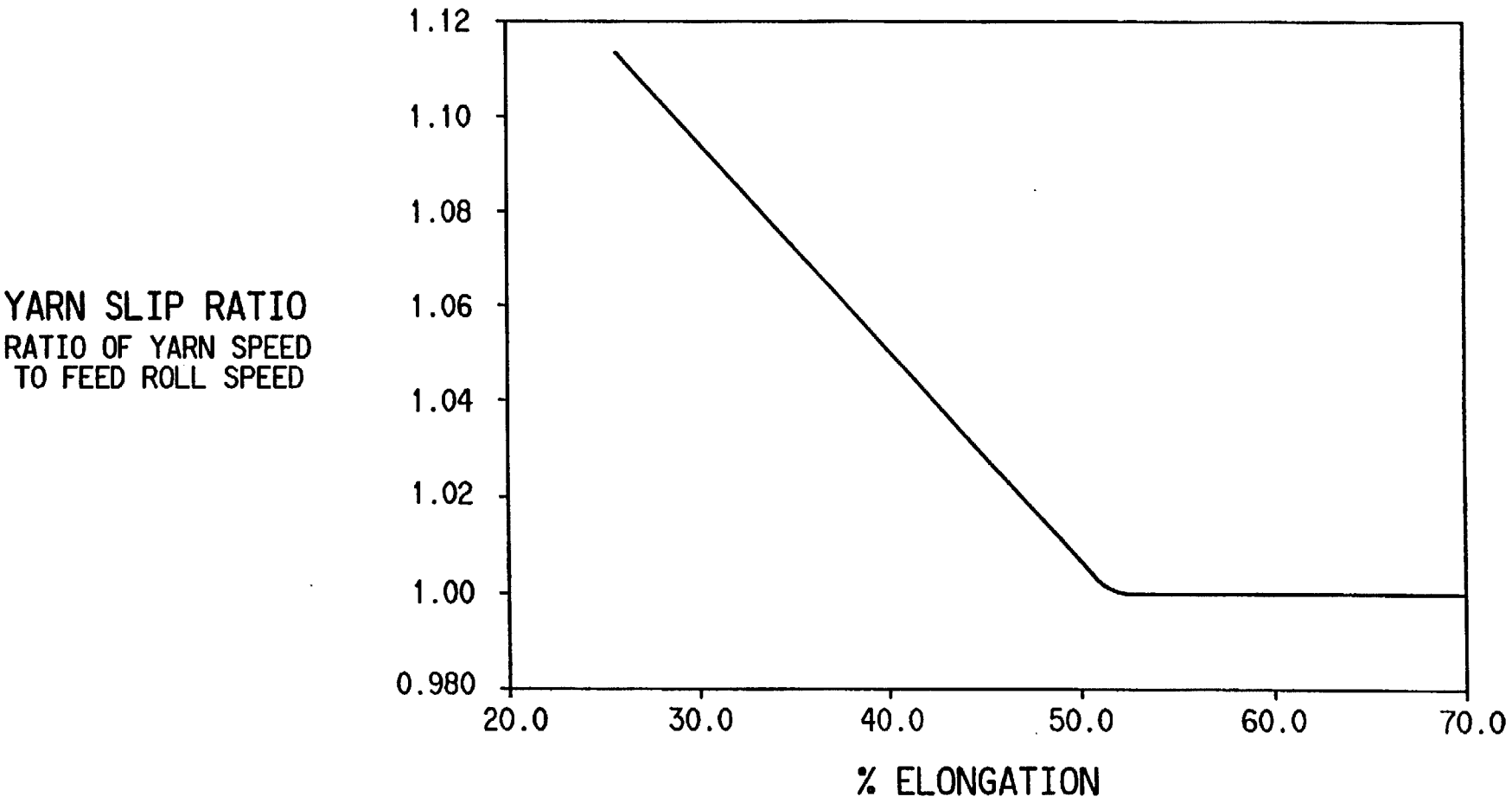
FIG. 5 is a graphical representation for a prior art nylon drawing processes using a cold "space" draw of yarn slip ratio (ratio of actual yarn speed to feed roll speed) versus the final yarn elongation.

In accordance with a preferred form of the invention, the yarn is heated in the drawing step so that the yarn draw point, i.e., the location of neck-drawing in the process, occurs in space between the feed godet rolls 50 and the draw godet rolls 70. FIG. 5 illustrates the relationship between the location of the draw point in terms of a yarn slip ratio (calculated from yarn speed divided by the feed godet surface speed) versus final yarn elongation in a prior art process such as the process of Swiss Patent No. 623 611. The draw point location can be determined by measuring the yarn speed on the last wrap of the feed godet by laser Doppler velocimetry. If the draw point is in space, the yarn speed will equal the godet speed; if the yarn speed is greater than the godet speed, then the draw point has moved onto the godet.

Consistent with FIG. 5, it has been observed that the location of the draw point is primarily a function of the final yarn elongation and is relatively independent of spinning speed or yarn RV in the speed and RV ranges of interest to the process of the invention. When the yarn is not heated as in prior art processes, FIG. 5 shows that the draw point is located in space for final yarn elongations of less than or equal to about 50%. However, when the final yarn elongation is less than about 50%, the draw point moves onto the feed roll. It has also been observed for prior art processes that the number of broken filaments produced increases when final yarn elongations are less that about 50%. It is believed that the higher broken filament level is due to the draw point being on the feed roll causing non-uniform drawing of the individual filaments as they slip over the surface of the roll. Consequently, in this preferred process in accordance with the invention, the yarn is heated to keep the yarn draw point from backing up onto the feed godet rolls 50 so that yarns with elongations substantially below 50% can be provided without broken filament defects increasing to unacceptable levels.

Preferably, heating the yarn to cause the draw point to be between the feed godets 50 and the draw godets 70 is accomplished by the passing the yarn through draw assist jet 60 including a chamber having a length of, for example, 0.1 to 0.2 meters in which a jet of steam impinges on the yarn in an intersecting relationship to the path of yarn travel. The steam draw assist jet may be operated at steam pressures between about 5 and about 80 psi (about 35 to about 550 kPa) which is sufficient heating to localize the drawpoint for normal textile filament deniers.

The yarn 40 is forwarded from the draw godet rolls 70 to a steam heated relaxation and entanglement jet (relaxation jet) 80. In the process in accordance with the invention, the relaxation jet 80 serves the purpose of reducing shrinkage so that the yarn has the desired boil-off shrinkage (BOS) for end use needs and also reduces retraction so that tube compression is controlled. In addition, the relaxation jet 80 intermingles, i.e., interlaces, the yarn which eliminates the need for a separate air driven interlacing jet before wind-up.

A preferred construction for the relaxation jet 80 is for the jet to includes a chamber for containing the yarn and a steam jet which impinges upon the yarn in the chamber in an intersecting relationship, preferable at a right angle, to the path of yarn travel. Suitable steam pressures for the supply steam for relaxation jet are about 20 to about 120 psi (140 to 830 kPa).

Figure 7:
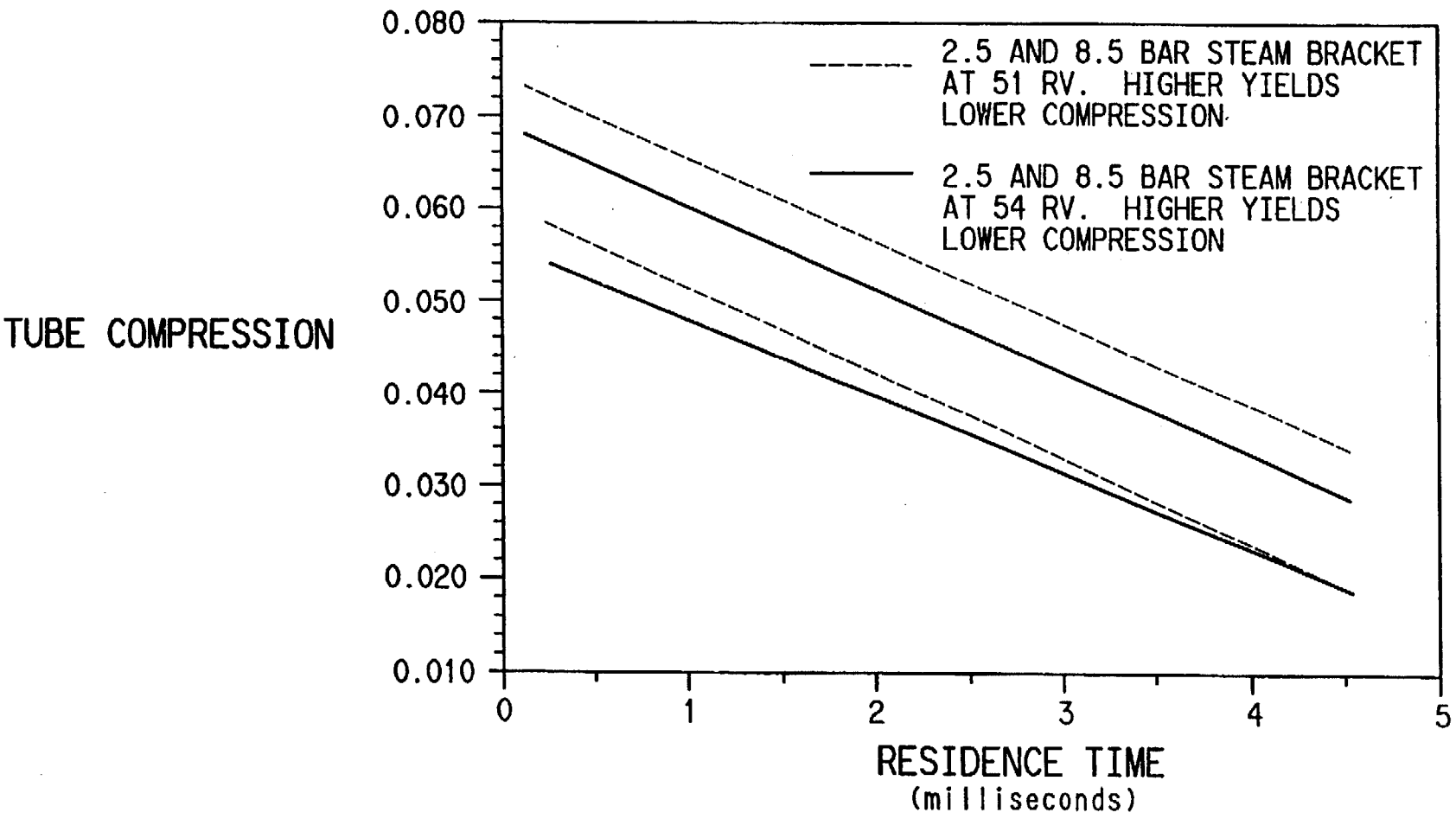
FIG. 7 is a graphical representation of tube compression versus residence time in the steam relaxation jet for preferred processes in accordance with invention.

At the high process speeds of the present invention, the residence times provided by relaxation jets as used in prior art process fail to reduce the yarn retraction to acceptable levels and tube compression is typically severe enough to prevent the yarn packages from being removed from the wind-up. It has been discovered that by using a relaxation jet with increased residence time, tube compression is substantially reduced. FIG. 7 illustrates the relationship between residence time in the steam jet and tube compression. As residence time increases, tube compression decreases. Increasing the steam pressure also has a beneficial effect on tube compression but the response is much less than the effect of increased residence time. The affects of adjusting the RV are also seen in FIG. 7.

In accordance with one preferred form of the process of the invention, the yarn is relaxed by passing the yarn through a steam atmosphere so that the yarn is exposed to the steam atmosphere for at least about 1 millisecond. This residence time in the jet is substantially longer than has been employed in prior art processes which have residence times typically of much less than about 0.5 millisecond. Preferably, the residence time in the process of the invention is at least about 2 milliseconds, most preferably at least about 2.4 milliseconds.

The increased residence time in the steam atmosphere is preferably provided by using a relaxation jet having a chamber of increased length to increase the length of the heat relaxation treatment zone. A suitable chamber length has been found to be at least about 0.3 meters, most preferably at least about 0.5 meters. The use of increased residence time in the relaxation jet has not been observed to cause negative effects on yarn quality. FIG. 2 shows that the RV can be increased to greater levels using a relaxation jet of increased length and still keep the yarn tube compression at acceptable levels.

With reference again to FIG. 6, it has been discovered that tube compression is reduced by controlling the tension of the yarn 40 in the relaxation jet 80 by contacting the yarn with a roll after the yarn exits the relaxation jet. Typically, the tension on the yarn at wind-up is on the order of about 0.1 to about 0.2 grams per denier (gpd) to provide good package formation but it has now been observed that this is often higher than is desired for the treatment of the yarn entering the relaxation jet. Preferably, the tension on the yarn entering the relaxation jet 80 is less than the tension at wind-up and most preferably is in the range 0.05 to about 0.125 gpd. In a preferred form of the process illustrated in FIG. 6, tension control in the relaxation jet 80 is accomplished by contacting the yarn after leaving the relaxation jet 80 with tension control rolls 90 and 100 before the yarn reaches the wind-up 120. The rolls 90 and 100 are arranged so that the yarn changes direction on and makes an "s-wrap" around the rolls with a sufficient wrap angle that the yarn winding tension can be isolated from the relaxation tension by controlling the speed of rolls 90 and 100.

In addition, the use of rolls 90 and 100 causes the yarn to travel for a longer distance between the relaxation jet and the wind-up than is typically used in prior art processes where the distance is on the order of about 1.7 meters. Advancing the yarn through the distance between the relaxation jet 80 and the wind-up 110 is referred to in this application as "lagging". It has been discovered that, by increasing the lagging distance, the tube retraction of the yarn can also be reduced. It is believed that this effect is due to the need, under the extremely high speeds being employed, for additional time for crystallization of the yarn before winding on the package. It is preferred for the lagging distance to be at least about 2 meters, most preferably at least about 3 meters.

In accordance with a form of the process of the invention which employs the combination of both tension control in the relaxation jet and lagging the yarn for a distance of about 2 meters, good results can obtained with a relaxation jet as used in known processes which provides a residence time of less than 0.5 milliseconds. However, a more versatile and more predictable process which is capable of higher speeds with acceptable tube compression is obtained if a steam jet with residence time of at least about 1 millisecond is also employed.

Referring again to FIG. 6, secondary yarn finish, if desired, is applied using finish applicator 110 before the yarn package winding takes place at wind-up 120.

The process provides novel fully-oriented yarns products which can be characterized by, in addition to tensile and shrinkage properties, X-ray fine structure parameters obtained by wide-angle X-ray diffraction (WAXD) and small-angle x-ray scattering (SAXS). Obtained from WAXD are: the crystalline perfection index (CPI), i.e., an estimate from interplanar spacings of the crystallographic planes to that of perfect nylon 6,6 crystal arbitrarily set at 100 units; and the orientation angle (Orient Angle), i.e., an average orientation of the crystallites relative to the fiber axis. Combining CPI and orientation angle with the SAXS parameters, long-period spacing (LP Space) or average distance between repeat crystalline phases and the average peak intensity (intensity or a measure of the "sharpness" of the crystalline and amorphous phases) normalized and reported as long period intensity (LP Intensity) provides a more complete assessment of the x-ray fine structure.

In accordance with another aspect of the invention, a fully-oriented yarn is provided which comprises nylon 66 polymer having a formic acid relative viscosity (RV) of about 40 to about 60 and having an elongation at break of about 22% to about 60%, a boil-off shrinkage between about 3% and about 10%, a tenacity of about 3 to about 7 gpd, a crystalline perfection index of about 61 to about 85, an orientation angle of about 12 to about 19, a long period spacing of about 79Å to about 103Å and a long period intensity of about 165 to about 2240. Preferably, the fully-oriented nylon 66 yarn has a formic acid relative viscosity (RV) of about 48 to about 53 and the crystalline perfection index is about 68 to about 76, the orientation angle is about 12 to about 18, the long period spacing is about 85Å to about 99Å and the long period intensity is about 450 to about 1400.

In accordance with the invention, a fully-oriented yarn is provided which comprises nylon 6 polymer having a formic acid relative viscosity (RV) of about 40 to about 60 and having an elongation at break of about 22% to about 60%, a boil-off shrinkage between about 7% and about 15%, a tenacity of about 3 to about 7 gpd, an orientation angle of about 9 to about 16, a long period spacing of about 65Å to about 85Å and a long period intensity of about 100 to about 820. Preferably, the fully-oriented nylon 6 yarn has a formic acid relative viscosity of about 53 to 58, an orientation angle is about 10 to about 13, a long period spacing of about 76Å to about 84Å and a long period intensity of about 400 to about 775. Preferably, the boil-off shrinkage of the nylon 6 fully-oriented yarn is about 7% to about 10%.

The invention is illustrated in the following Examples which illustrate preferred embodiments of the invention. Parts and percentages are by weight unless otherwise indicated. Measurements are made using the Test Methods described following the Examples.

EXAMPLES

To produce a 40 denier, 13 filament fully-oriented nylon 66 yarn, a spinning machine as described in Swiss Patent No. 623 611 is supplied with nylon 66 polymer flake containing 0.30% $TiO_2$ conditioned to yield, when spun, a formic acid relative viscosity (RV) of 42.3 in the yarn. The polymer is extruded at 290° C. through a 13 hole spinneret with trilobal cross-section capillaries and quenched with a cross flow air stream at 0.3 meters/second air velocity.

The quenched filaments are withdrawn from the quench, receive an application of finish, are coalesced into a yarn before contacting the feed godet roll pair. The yarn is wrapped 2.5 times around the feed godet roll pair which has a surface speed of 5250 meters/minute (mpm) and passes to a draw godet pair operating at 6773 mpm where it is wrapped 3.5 times. The draw ratio is thus about 1.3.

The drawn yarn is then passed to a steam relaxation and entanglement device (relaxation jet) having a chamber into which steam at 6 bar (600 kPa) gage pressure is supplied through a steam jet which causes the steam to impinge the yarn at a right angle to the path of travel. The length of the chamber is about 0.05 meters in length so that the residence time in the device is 0.44 milliseconds. The yarn so treated is then packaged on tube core at a windup operating at 6173 mpm at a winding tension of 8 grams (0.2 gpd). The position of the wind-up in relation to the relaxation jet is such that the yarn travels a distance of about 1.7 meters between the steamer and the wind-up.

After a two hour wind cycle, the package of 40 denier yarn could not be removed from the winding chuck apparently due to retraction of the yarn which has sufficient force to crush the tube core. A commercially usable package of yarn could not be obtained since packages had to be cut off of the winding chuck.

EXAMPLE 1

This example illustrates the process of the invention to make 40 denier, 13 filament fully-oriented nylon 66 yarns using a steam jet in the draw stage to maintain the draw point between the feed rolls and the draw rolls, tension control for the yarn in a relaxation jet (same jet as in Comparative Example 1), and lagging for a distance of about 2.7 meters before wind-up.

Part A

A spinning machine as illustrated in FIG. 6 is supplied with nylon 66 polymer flake containing 0.30% $TiO_2$ and being conditioned to yield, when spun, an RV in the yarn corresponding to the three yarn RV values shown in TABLE 1A below. The polymer is extruded at 288° C. through a spinneret of the same configuration as in Comparative Example 1 and is quenched using the same quench conditions. The yarn is then wrapped 2.5 times around a feed godet pair having a surface speed of 5600 mpm and passes to a draw godet pair operating at 6750 mpm where it is wrapped 3.5 times. The draw ratio is thus about 1.2. A steam chamber having a length of approximately 0.17 meters in which a steam jet impinges in a perpendicular relationship is located between the feed rolls and the draw rolls. Steam at a pressure of 10 psi (70 kPa) is supplied to the jet so that the steam jet functions to maintain the draw point between the feed rolls and the draw rolls.

The drawn yarn is then relaxed by passing through the same relaxation jet as in Comparative Example 1 in which the yarn residence time is approximately 0.44 milliseconds. However, as illustrated in FIG. 6, the tension for the yarn in the relaxation jet is controlled by means of a pair of tension control rolls in an "S-wrap" arrangement, i.e., the yarn contacts and changes direction once on each roll. The speed of the tension control rolls is 6420 mpm which provides a total tension of the yarn entering the relaxation jet of 3 g (0.075 gpd). Finally, the yarn is packaged on a windup operating at 6300 mpm using a 5 gram total winding tension (0.125 gpd). The position of the wind-up in relation to the relaxation jet and the position of the tension control rolls is such that the yarn is lagged, i.e., travels a distance of about 2.7 meters between the relaxation jet and the wind-up.

The yarn defect level per million end yards (MEY) and yarn tube compression (change in inside diameter of yarn tube with yarn on tube reported in inches) are then determined and are reported in TABLE 1A. Measured yarns properties are reported in TABLE 1A (Continued).

TABLE 1A

| Item | Yarn RV | Defects/MEY | Yarn Tube Compression |
|---|---|---|---|
| 1 | 38.4 | 62 | — |
| 2 | 52.2 | 10 | 0.042 |
| 3 | 60.8 | 0 | 0.053 |

| Item | Elong | Ten | BOS | CPI | Orient Angle | LP Space | LP Intensity |
|---|---|---|---|---|---|---|---|
| 1 | 39 | 5.2 | 6.7 | 70.4 | 13.1 | 82.0 | 169 |
| 2 | 46 | 4.4 | 6.7 | 76.0 | 15.3 | 87.0 | 570 |
| 2 | 52 | 3.9 | 6.3 | 80.2 | 17.6 | 93.0 | 911 |

Part B

The above example is repeated with a 5800 mpm feed godet speed, a 6496 mpm draw godet speed (draw ratio of approximately 1.2), a tension control roll speeds of 6235 mpm (item 1) and 6270 mpm (item 2) and a wind-up speed of about 6135 mpm. The yarn residence time in the relaxation steam jet is approximately 0.46 milliseconds. The tension on the yarn entering the relaxation jet is about 3.5 g (0.875 gpd) and the winding tension is approximately 5 grams (0.125 gpd). The yarn defect level per million end yards (MEY) and yarn tube compression are then determined and are reported in TABLE 1B. Measured yarns properties are reported in TABLE 1B (Continued).

TABLE 1B

| Item | Yarn RV | Defects/MEY | Yarn Tube Compression |
|---|---|---|---|
| 1 | 38.4 | 72 | 0.032 |
| 2 | 60.8 | 0 | 0.054 |

| Item | Elong | Ten | BOS | CPI | Orient Angle | LP Space | LP Intensity |
|---|---|---|---|---|---|---|---|
| 1 | 50 | 4.7 | 5.2 | 73.5 | 13.5 | 79.0 | 266 |
| 2 | 54 | 3.7 | 5.6 | 80.9 | 16.9 | 92.0 | 1126 |

Part C

The above example is repeated with a 5400 mpm feed godet speed, a 6480 mpm draw godet speed (draw ratio of approximately 1.2), tension control roll speeds of 6125 mpm (item 2) and 6160 mpm (items 1,3) and a wind-up speed of about 6060 mpm. The residence time in the relaxation steam jet is approximately 0.46 milliseconds. The tension on the yarn entering the relaxation jet is about 3.5 g (0.0875 gpd) and the winding tension is approximately 5 grams (0.125 gpd). The yarn defect level per million end yards (MEY) and yarn tube compression are then determined and are reported results reported in TABLE 1C. Measured yarns properties are reported in TABLE 1C (Continued).

TABLE 1C

| Item | Yarn RV | Defects/MEY | Yarn Tube Compression |
|---|---|---|---|
| 1 | 38.4 | 41 | 0.035 |
| 2 | 52.2 | 0 | 0.034 |
| 3 | 60.8 | 0 | 0.057 |

| Item | Elong | Ten | BOS | CPI | Orient Angle | LP Space | LP Intensity |
|---|---|---|---|---|---|---|---|
| 1 | 144 | 4.6 | 5.2 | 69.7 | 14.5 | 82.0 | 196 |
| 2 | 48 | 4.2 | 5.6 | 73.8 | 16.4 | 85.0 | 449 |
| 3 | 50 | 3.8 | 6.7 | 79.0 | 17.4 | 93.0 | 950 |

EXAMPLE 2

This example illustrates the process of the invention to make 40 denier, 13 filament fully-oriented nylon 66 yarns using a steam jet in the draw stage to maintain the draw point between the feed rolls and the draw rolls, a relaxation and entanglement jet (relaxation jet) of increased length, i.e., 0.5 meters, tension control for the yarn in the relaxation jet, and lagging for a distance of about 4.2 meters before wind-up.

Part A

A spinning machine as illustrated in FIG. 6 is supplied with nylon 66 polymer flake containing 0.30% $TiO_2$ and having an initial RV and being conditioned to yield, when spun, an RV in the yarn corresponding to the three yarn RV values shown in TABLE 2A below. The polymer is extruded at 288° C. through a spinneret of same configuration in Example 1 and using the same quench conditions. The yarn is then wrapped 2.5 times around a feed godet pair having a surface speed of 5600 mpm and passes to a draw godet pair operating at 6972 mpm where it is wrapped 3.5 times. The draw ratio is thus about 1.25. A steam jet as in Example 1 is used between the feed rolls and the draw rolls which functions to maintain the draw point between the feed rolls and the draw rolls.

The drawn yarn is then relaxed by passing through a steam relaxation and entanglement device (relaxation jet) of increased length over the previous examples. The length of the relaxation jet is 0.5 meter in which the yarn residence time is about 4.3 milliseconds. As illustrated in FIG. 6, the tension for the yarn in the relaxation jet is controlled by means of a pair of tension control rolls in an "S-wrap" arrangement, i.e., the yarn contacts and changes direction once on each roll. The speed of the tension control rolls is 6485 mpm which provides a total tension of the yarn entering the relaxation jet of about 3 g (0.075 gpd).

Finally, the yarn is packaged on a windup operating at 6415 mpm and a 6 grams total winding tension (0.15 gpd). The position of the wind-up in relation to the relaxation jet and the position of the tension control rolls is such that the yarn is lagged, i.e., travels a distance of about 4.2 meters between the relaxation jet and the wind-up.

The yarn defect level per million end yards (MEY) and yarn tube compression are then determined and are reported in TABLE 2A. Measured yarns properties are reported in TABLE 2A (Continued).

TABLE 2A

| Item | Yarn RV | Defects/MEY | Yarn Tube Compression |
|---|---|---|---|
| 1 | 50.0 | 43 | 0.034 |
| 2 | 55.1 | 6 | 0.039 |

TABLE 2A-continued

| 3 | 61.8 | | 6 | | 0.054 | | |
|---|---|---|---|---|---|---|---|
| Item | Elong | Ten | BOS | CPI | Orient Angle | LP Space | LP Intensity |
| 1 | 42 | 4.7 | 4.1 | 71.5 | 13 | 92.5 | 734 |
| 2 | 45 | 4.5 | 6.5 | 75.6 | 12.6 | 97 | 774 |
| 3 | 48 | 4.4 | 6.9 | 78.8 | 14.1 | 100 | 1048 |

Part B

This Example is repeated with a 5400 mpm feed godet speed, 6858 mpm draw godet speed (draw ratio of approximately 1.27), a tension control roll speed of 6370 mpm (item 1) and 6435 mpm (item 2), and a winding speed of approximately 6340 mpm. The residence time in the relaxation steam jet is approximately 4.4 milliseconds. The tension on the yarn entering the relaxation jet is about 3 g (0.075 gpd) and the winding tension is approximately 6 grams (0.15 gpd). The yarn defect level per million end yards (MEY) and yarn tube compression are then determined and are reported in TABLE 2B. Measured yarns properties are reported in TABLE 2B (Continued).

TABLE 2B

| Item | Yarn RV | Defects/MEY | Yarn Tube Compression |
|---|---|---|---|
| 1 | 50.0 | 7 | 0.033 |
| 2 | 61.8 | 0 | 0.074 |

| Item | Elong | Ten | BOS | CPI | Orient Angle | LP Space | LP Intensity |
|---|---|---|---|---|---|---|---|
| 1 | 44 | 4.9 | 6.3 | 70.6 | 13 | 94 | 705 |
| 2 | 49 | 4.5 | 6.7 | 81.1 | 14.7 | 100 | 1256 |

Part C

This example is repeated with a 5800 mpm feed godet speed, 7366 mpm draw godet speed (draw ratio of approximately 1.27), a tension control roll speed of 6820 mpm (Items 1.2) and 6855 mpm (Item 3), and a winding speed of approximately 6760 mpm. The residence time in the relaxation steam jet is approximately 4.1 milliseconds. The tension on the yarn entering the relaxation jet is about 3 g (0.075 gpd) and the winding tension is approximately 6 grams (0.15 gpd). The yarn defect level per million end yards (MEY) and yarn tube compression are then determined and are reported in TABLE 2C. Measured yarns properties are reported in TABLE 2C (Continued).

TABLE 2C

| Item | Yarn RV | Defects/MEY | Yarn Tube Compression |
|---|---|---|---|
| 1 | 50.0 | 125 | 0.038 |
| 2 | 55.1 | 10 | 0.040 |
| 3 | 61.8 | 7 | 0.070 |

| Item | Elong | Ten | BOS | CPI | Orient Angle | LP Space | LP Intensity |
|---|---|---|---|---|---|---|---|
| 1 | 36 | 4.9 | 6.7 | 72.5 | 12.3 | 96 | 939 |
| 2 | 41 | 4.7 | 6.3 | 80.7 | 12.5 | 98.5 | 980 |
| 3 | 44 | 4.6 | 7.8 | 82.9 | 12.8 | 102 | 1628 |

EXAMPLE 3

This example illustrates the process of the invention to make 40 denier, 13 filament fully-oriented nylon 6 yarns using nylon 6 polymer at three different RV levels. The same spinning equipment is used as in Example 2 except that the chamber of the relaxation jet has a length of about 0.52 meters.

Item 1

Nylon 6 homopolymer having an RV of 49.6 containing 0.03% $TiO_2$ is spun and withdrawn from the spinneret with a feed godet having speed of 5588 mpm and a 6570 mpm draw godet speed is used. The draw ratio is thus approximately 1.18. The tension control roll speed is 6200 mpm and the winding speed is approximately 6170 mpm. The residence time in the relaxation steam jet is approximately 4.7 milliseconds. The tension on the yarn entering the relaxation jet is about 3 g (0.075 gpd) and the winding tension is approximately 5.5 grams (0.14 gpd).

Item 2

Item 1 is repeated with nylon 6 homopolymer having an RV of 57.5, a 5740 mpm feed godet speed, 6570 mpm draw godet speed (draw ratio of approximately 1.15), a tension control roll speed of 6250 mpm, and a winding speed of approximately 6165 mpm. The residence time in the relaxation steam jet is approximately 4.7 milliseconds. The tension on the yarn in the relaxation jet is about 3 g (0.075 gpd) and the winding tension is approximately 5.9 grams (0.15 gpd).

Item 3

Item 1 is again repeated with nylon 6 homopolymer having an RV of 63.4, a 5417 mpm feed godet speed, 6570 mpm draw godet speed (draw ratio of approximately 1.2), a tension control roll speed of 6205 mpm, and a winding speed of approximately 6100 mpm. The residence time in the relaxation steam jet is approximately 4.7 milliseconds. The tension on the yarn entering the relaxation jet is about 3 g (0.075 gpd) and the winding tension is approximately 5.5 grams (0.14 gpd).

For Items 1, 2 and 3, the yarn defect level per million end yards (MEY) and yarn tube compression are then determined and are reported in TABLE 3. Measured yarns properties are reported in TABLE 3 (Continued).

TABLE 3

| Item | Yarn RV | Defects/MEY | Yarn Tube Compression |
|---|---|---|---|
| 1 | 49.6 | 9 | 0.035 |
| 2 | 57.5 | 0 | 0.032 |
| 3 | 63.4 | 0 | 0.030 |

| Item | Elong | Ten | BOS | CPI | Orient Angle | LP Space | LP Intensity |
|---|---|---|---|---|---|---|---|
| 1 | 40 | 4.0 | 8.7 | — | 11.3 | 79.0 | 493 |
| 2 | 42 | 3.7 | 8.3 | — | — | — | — |
| 2 | 39.5 | 3.8 | 7.7 | — | 12 | 82.5 | 658 |

TEST METHODS

Relative Viscosity (RV) of the polyamide refers to the ratio of solution and solvent viscosities measured at 25° C. in a solution of 8.4% by weight polyamide polymer in a solvent of formic acid containing 10% by weight of water.

Filament Defects Per Million Ends Of Yarn (Defects/MEY) is measured by placing ten sample tubes in the creel of a test instrument which has the capability to feed the yarn through a "cleaner guide" (a slotted guide with a narrow opening matched to the yarn denier for catching defects in the moving threadline). The threadlines are each lead through a yarn guide, through a "cleaner guide" having a 0.002 inch wide opening (for 40 denier) and then to a aspirator jet. A yarn defect (usually a broken filament in the threadline) will catch in the cleaner and each such defect caught will be counted as a defect. After the defect is counted the threadline will be freed and allowed to continue running. Only three defects are generally counted for each threadline to prevent one very bad threadline from skewing the data. This test is usually run for 30 minutes for each item. The yarn drawn off is weighed to determine the yards of yarn tested. The results are reported as defects divided by the number of million yarns tested and expressed as defects per million end yards (defects/MEY).

Yarn Tube Compression (Tube Compress) is determined by measuring the inside diameter of the yarn tube at the center of the tube with a three point micrometer and the data recorded prior to placing the tube on the windup. Then 180,000 meters of yarn is wound on the tube and the tube removed from the windup. The yarn package is allowed to age for 24 hours and the inside diameter of the tube is measured again. The difference between the measurement before winding and the measurement after winding and aging is the tube compression expressed in inches.

Tenacity and Break Elongation are measured as described by Li in U.S. Pat. No. 4,521,484 at column 2, line 61 to column 3, line 6. The number of measurements used for the calculation of sigma are indicated by "n=" in the tables which follow.

Boil-Off Shrinkage (BOS) is measured according to the method in U.S. Pat. No. 3,772,872 column 3, line 49 to column 3 line 66. Boil-off Shrinkage Coefficient of variation is calculated using the number of measurements indicated by "n=".

Crystal Perfection Index (CPI) is derived from X-ray diffraction scans. The diffraction pattern of fiber of these compositions is characterized by two prominent equatorial X-ray reflections with peaks occurring at scattering angles approximately 20° to 21° and 23°2θ. X-ray patterns were recorded on a Xentronics area detector (Model X200B, 10 cm diameter with a 512 by 512 resolution). The X-ray source was a Siemens/Nicolet (3.0 kW) generator operated at 40 kV and 35 mA with a copper radiation source (CU K-alpha, 1.5418 angstroms wavelength). A 0.5 mm collimator was used with sample to camera distance of 10 cm. The detector was centered at an angle of 20 degrees (2θ) to maximize resolution. Exposure time for data collection varied from 10 to 20 minutes to obtain optimum signal level.

Data collection, on the area detector, is started with initial calibration using an Fe55 radiation source which corrects for relative efficiency of detection from individual locations on the detector. Then a background scan is obtained with a blank sample holder to define and remove air scattering of the X-ray beam from the final X-ray pattern. Data is also corrected for the curvature of the detector by using a fiducial plate that contains equally spaced holes on a square grid that is attached to the face of the detector. Sample fiber mounting is vertical at 0.5 to 1.0 mm thick and approximately 10 mm long, with scattering data collected in the equatorial direction or normal to the fiber axis. A computer program analyses the X-ray diffraction data by enabling one dimensional section construction in the appropriate directions, smoothes the data and measures the peak position and full width at half maximum.

The X-ray diffraction measurement of crystallinity in 66 nylon, and copolymers of 66 and 6 nylon is the Crystal Perfection Index (CPI) (as taught by P. F. Dismore and W. O. Statton, *J. Polym. Sci.* Part C, No. 13, pp. 133–148, 1966). The positions of the two peaks at 21° and 23° 2θ are observed to shift, and as the crystallinity increases, the peaks shift farther apart and approach the positions corresponding to the "ideal" positions based on the Bunn-Garner 66 nylon structure. This shift in peak location provides the basis of the measurement of Crystal Perfection Index in 66 nylon:

$$CPI = \frac{[d(\text{outer})/d(\text{inner})] - 1}{0.189} \times 100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc. (London), A189, 39, 1947). An equivalent and more useful equation, based on 20 values, is:

$$CPI = [2\theta(\text{outer})/2\theta(\text{inner}) - 1] \times 546.7$$

X-ray Orientation Angle (Orient Angle)

The same procedures (as discussed in the previous CPI section) are used to obtain and analyze the X-ray diffraction patterns. The diffraction pattern of 66 nylon and copolymers of 66 and 6 nylon has two prominent equatorial reflections at 2θ approximately 20° to 21° and 23°. For 6 nylon one prominent equatorial reflection occurs at 2θ approximately 20° to 21°. The approximately 21° equatorial reflection is used for the measurement of Orientation Angle. A data array equivalent to an azimuthal trace through the equatorial peaks is created from the image data file.

The Orientation Angle (Orient Angle) is taken to be the arc length in degrees at the half-maximum optical density (angle subtending points of 50 percent of maximum density) of the equatorial peak, corrected for background.

The Long Period Spacing (LP Space), and Long Period Intensity (LP Intensity)

The LP Space and LP Intensity are obtained from small angle X-ray scattering (SAXS) patterns recorded on a Xentronics area detector (Model X200B, 10 cm diameter with a 512 by 512 resolution). The X-ray source was a Siemens/Nicolet (3.0 kW) generator operated at 40 kV and 35 mA with a copper radiation source (CU K-alpha, 1.5418 angstroms wavelength). A 0.3 mm collimator was used with sample to camera distance of 40 cm. For most nylon fibers, a reflection is observed in the vicinity of 1°2θ. The detector was centered at an angle of 0° (2θ) to maximize resolution. Exposure time for data collection varied from ½ to 4 hours to obtain optimum signal level.

Data collection, on the area detector, is started with initial calibration using an Fe55 radiation source which corrects for relative efficiency of detection from individual locations on the detector. Then a background scan is obtained with a blank sample holder to define and remove air scattering of the X-ray beam from the final X-ray pattern. Data is also corrected for the curvature of the detector by using a fiducial plate that contains equally spaced holes on a square grid that is attached to the face of the detector. Sample fiber mounting is vertical at 0.5 to 1.0 mm thick and approximately 10 mm long, with scattering data collected in the meridional and equatorial direction.

Scanning patterns were analyzed in the meridional direction and parallel to the equatorial direction, through the intensity maxima of the two scattering peaks. Two symmetrical SAXS spots, due to long period spacing distribution, were fitted with a Pearson VII function [see: Heuval et al., *J. Appl. Poly. Sci.*, 22, 2229–2243 (1978)] to obtain maximum intensity, position and full-width at half-maximum.

The Long Period Spacing (LP Space) is calculated from the Bragg Law using the peak position thus derived. For small angles this reduces to 1.5418/(sin (2θ)).

The SAXS Long Period Intensity (LP Intensity), normalized for one hour collection time; the average intensity (Avg. Int.) of the four scattering peaks corrected for sample thickness (Mult. Factor) and exposure time, were calculated. The Long Period Intensity (LP Intensity) is a measure of he difference in electron density between amorphous and crystalline regions of the polymer comprising the filament; i.e., LP Intensity=[Avg.Int. X Mult.Factor×60]/[Collect time, min.].

What is claimed is:

1. A package comprising a cardboard tube and a yarn wound on the tube, the yarn comprising nylon 66 polymer having a formic acid relative viscosity (RV) of about 40 to about 60 and having an elongation at break of about 22% to about 60%, a boil-off shrinkage of about 3% to about 10%, a tenacity of about 3 to about 7 gpd, a crystalline perfection index of about 61 to about 85, an orientation angle of about 12 to about 19, a long period spacing of about 79Å to about 103Å and a long period intensity of about 165 to about 2240, having a Yarn Tube Compression insufficient to crush the tube.

2. The package of claim 1 wherein said formic acid relative viscosity (RV) is about 48 to about 53 and said crystalline perfection index is about 68 to about 76, said orientation angle is about 12 to about 18, said long period spacing is about 85Å to about 99Å and said long period intensity is about 450 to about 1400.

3. The package of claim 1, wherein the Yarn Tube Compression is about 0.032 inches to about 0.074 inches.

* * * * *